US008166943B2

(12) United States Patent
Chamarthi et al.

(10) Patent No.: US 8,166,943 B2
(45) Date of Patent: May 1, 2012

(54) FUEL SYSTEM CONTROL

(75) Inventors: Gopal Krishna Chamarthi, Farmington Hills, MI (US); Brien Lloyd Fulton, West Bloomfield, MI (US); Christopher Oberski, Plymouth, MI (US); Peter Mitchell Lyon, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 370 days.

(21) Appl. No.: 12/533,655

(22) Filed: Jul. 31, 2009

(65) Prior Publication Data

US 2011/0023833 A1 Feb. 3, 2011

(51) Int. Cl.
*F02D 41/06* (2006.01)

(52) U.S. Cl. ..... 123/179.17

(58) Field of Classification Search ..... 123/446, 123/447, 497, 179.16, 179.17, 510, 514
See application file for complete search history.

(56) References Cited

U.S. PATENT DOCUMENTS

| | | | | |
|---|---|---|---|---|
| 4,454,848 | A * | 6/1984 | Duprez | 123/516 |
| 4,800,859 | A * | 1/1989 | Sagisaka et al. | 123/497 |
| 5,237,975 | A * | 8/1993 | Betki et al. | 123/497 |
| 5,425,342 | A * | 6/1995 | Ariga et al. | 123/456 |
| 5,598,817 | A * | 2/1997 | Igarashi et al. | 123/179.17 |
| 5,642,716 | A * | 7/1997 | Ricco | 123/456 |
| 5,651,347 | A * | 7/1997 | Oi et al. | 123/487 |
| 5,711,275 | A * | 1/1998 | Minagawa et al. | 123/458 |
| 5,758,622 | A * | 6/1998 | Rembold et al. | 123/456 |
| 5,842,454 | A * | 12/1998 | Miwa et al. | 123/497 |
| 5,927,253 | A * | 7/1999 | Oyafuso et al. | 123/456 |
| 6,024,064 | A * | 2/2000 | Kato et al. | 123/179.17 |
| 6,142,120 | A * | 11/2000 | Biester et al. | 123/456 |
| 6,234,151 | B1 | 5/2001 | Eck | |
| 6,269,801 | B1 * | 8/2001 | Channing | 123/516 |
| 6,279,532 | B1 * | 8/2001 | Takano et al. | 123/357 |
| 6,408,822 | B1 * | 6/2002 | Rembold et al. | 123/447 |
| 6,453,878 | B1 * | 9/2002 | Mazet | 123/497 |
| 6,622,708 | B2 * | 9/2003 | Braun et al. | 123/516 |
| 6,868,838 | B2 | 3/2005 | Piet | |
| 6,923,159 | B2 * | 8/2005 | Sakumoto et al. | 123/446 |
| 6,964,262 | B2 * | 11/2005 | Hayakawa | 123/458 |
| 6,964,267 | B2 | 11/2005 | Jin | |
| 7,093,576 | B2 * | 8/2006 | DeRaad | 123/179.17 |
| 7,163,003 | B2 * | 1/2007 | Bradford | 123/510 |
| 7,281,520 | B2 * | 10/2007 | Klenk et al. | 123/446 |
| 7,343,901 | B2 | 3/2008 | Mori et al. | |
| 7,412,953 | B2 * | 8/2008 | Shimazaki et al. | 123/179.16 |

(Continued)

FOREIGN PATENT DOCUMENTS

| | | |
|---|---|---|
| EP | 1 319 821 | 6/2003 |

(Continued)

*Primary Examiner* — Thomas Moulis
(74) *Attorney, Agent, or Firm* — Julia Voutyras; Alleman Hall McCoy Russell & Tuttle LLP

(57) ABSTRACT

Methods and systems are provided for operating a fuel system in an engine, the fuel system including a supply pump for delivering fuel to the fuel system and pressurizing fuel received from a feed pump, a fuel tank, a fuel filter for filtering fuel, a fuel rail, and a fuel injector. One example method comprises, during an engine cold-start, operating the supply pump, and adjusting a supply pump operation mode between at least a pressure-controlled mode and a volume-controlled mode based on a fuel temperature and pressure.

19 Claims, 4 Drawing Sheets

U.S. PATENT DOCUMENTS 7,448,361 B1 * 11/2008 Pursifull et al. ..... 123/456
7,448,363 B1 * 11/2008 Rasmussen et al. ..... 123/497
7,481,202 B2 * 1/2009 Posselt et al. ..... 123/497
7,775,191 B2 * 8/2010 Hou ..... 123/458
7,832,375 B2 * 11/2010 Dusa et al. ..... 123/446

FOREIGN PATENT DOCUMENTS

EP 1 612 397 1/2006

* cited by examiner

FUEL SYSTEM CONTROL

FIELD

The present application relates to methods and systems for controlling the fuel system of a diesel engine, specifically during a start and engine operation after start in cold ambient conditions.

BACKGROUND AND SUMMARY

Vehicle engines may be configured to operate using diesel fuels. However, at low ambient temperatures, such as during an engine cold-start, wax may precipitate out of the diesel fuel. The precipitated wax may clog a fuel filter while also reducing the fluidity of the fuel. The amount of wax that precipitates from the fuel may depend upon the fuel properties and ambient temperature the vehicle is started in. As such, the precipitated wax in the fuel reduces the pressure of the low pressure fuel system and performance of the high pressure fuel system and, if severe enough, can cause damage to the fuel system.

Various strategies may be used to reduce and remove the precipitation of wax from diesel fuels. In one example approach, the mode of operation of a supply pump that pressurizes fuel and supplies pressurized fuel to the fuel rail and injectors may be adjusted responsive to the fuel temperature. As such, the supply pump may be operated in a more power-intensive pressure-controlled mode or a more energy-efficient volume-controlled mode. In the aforementioned example approach, the pump may be operated in the pressure-controlled mode until the fuel temperature reaches a threshold temperature to address the wax in the fuel. In another example approach, fuel heaters may be used to heat the fuel and address the issue of wax build-up.

Yet another example approach is illustrated by Osaki in EP 1,319,821 A2. In EP '821, an engine fuel system is configured with a fuel recirculation passage for recirculating heated fuel, discharged by the supply pump, through a fuel filter. Specifically, during engine cold-starts, when the temperature of the fuel drawn into the supply pump is lower than a threshold temperature, the quantity of fuel flowing through the recirculating passage is increased while the quantity of fuel returned to the fuel tank may be reduced.

However, the inventors have recognized several potential issues with such approaches. As one example, there may be a trade-off between increased fuel economy and ensuring sufficient wax removal. Specifically, when adjusting the supply pump operation mode responsive to fuel temperature, if the temperature is set low (for example, to improve fuel economy), there may be insufficient wax removal during some conditions. Alternatively, if the temperature is set higher (to ensure sufficient wax removal), under some conditions this may prolong the high work load of the pump more than necessary, adversely impacting fuel economy. For example, a fuel system can be operating in pressure control mode even though wax has been removed, even during low temperatures. Thus, continuing high work loading of the pump may be unnecessary. Further still, variations in the fuel quality and properties may significantly affect how much, and at what temperatures, wax is formed or removed.

Thus in one example, some of the above issues may be addressed by a method of operating a fuel system in an engine, the fuel system including a supply pump for pressurizing fuel received from a low pressure feed pump, a fuel tank, a fuel filter for filtering fuel, a fuel rail, and a fuel injector. One example method comprises, during an engine cold-start, operating the supply pump, and adjusting the operation mode between at least a pressure-controlled mode and a volume-controlled mode based on a fuel temperature and pressure.

In one example, the operation of the supply pump in a vehicle fuel system may be adjusted responsive to both a temperature and pressure of the fuel. Herein, at the onset of an engine cold-start and during engine operation in cold ambient conditions, the supply pump may be operated in the more power-intensive pressure-controlled mode for an interval to rapidly raise the fuel temperature to a first threshold temperature and pressure. Once the threshold temperature and pressure have been attained, the supply pump operation may be switched to the more energy-efficient volume-controlled mode. By operating the supply pump responsive to both a temperature and pressure of the fuel, substantial fuel economy benefits may be achieved. For example, the combination of a higher pressure threshold and a lower temperature threshold may suffice to enable improved wax removal and increased fuel fluidity. In some examples, the higher pressure and lower temperature combination may entail a shorter pump operation, thereby reducing the fuel consumption of the vehicle.

Further improvements in fuel fluidity and wax removal may be achieved by recirculating at least some of the fuel pressurized and heated through the supply pump into the inlet of one or more system fuel filters along respective recirculation passages. Flow through the recirculation passages may be regulated by respective one or more thermal recirculation valves. As such, the heated return fuel may be re-circulated irrespective of the operating mode of the supply pump. The amount of return fuel re-circulated through the fuel filters may also be adjusted responsive to the fuel temperature and/or pressure by regulating the flow of return fuel through the thermal recirculation valves. During operation of the pump in the volume-controlled mode, the build-up and removal of wax at the fuel filter may be diagnosed by analyzing the pressure at the filter outlet. By adjusting the recirculation flow based on a fuel temperature and/or pressure, wax removal may be expedited and the quality of fuel injection may be improved. Furthermore, by diagnosing and distinguishing filter clogging due to wax build-up from filter clogging due to extraneous matter (i.e. contaminants such as dust), the quality of engine and pump operation may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
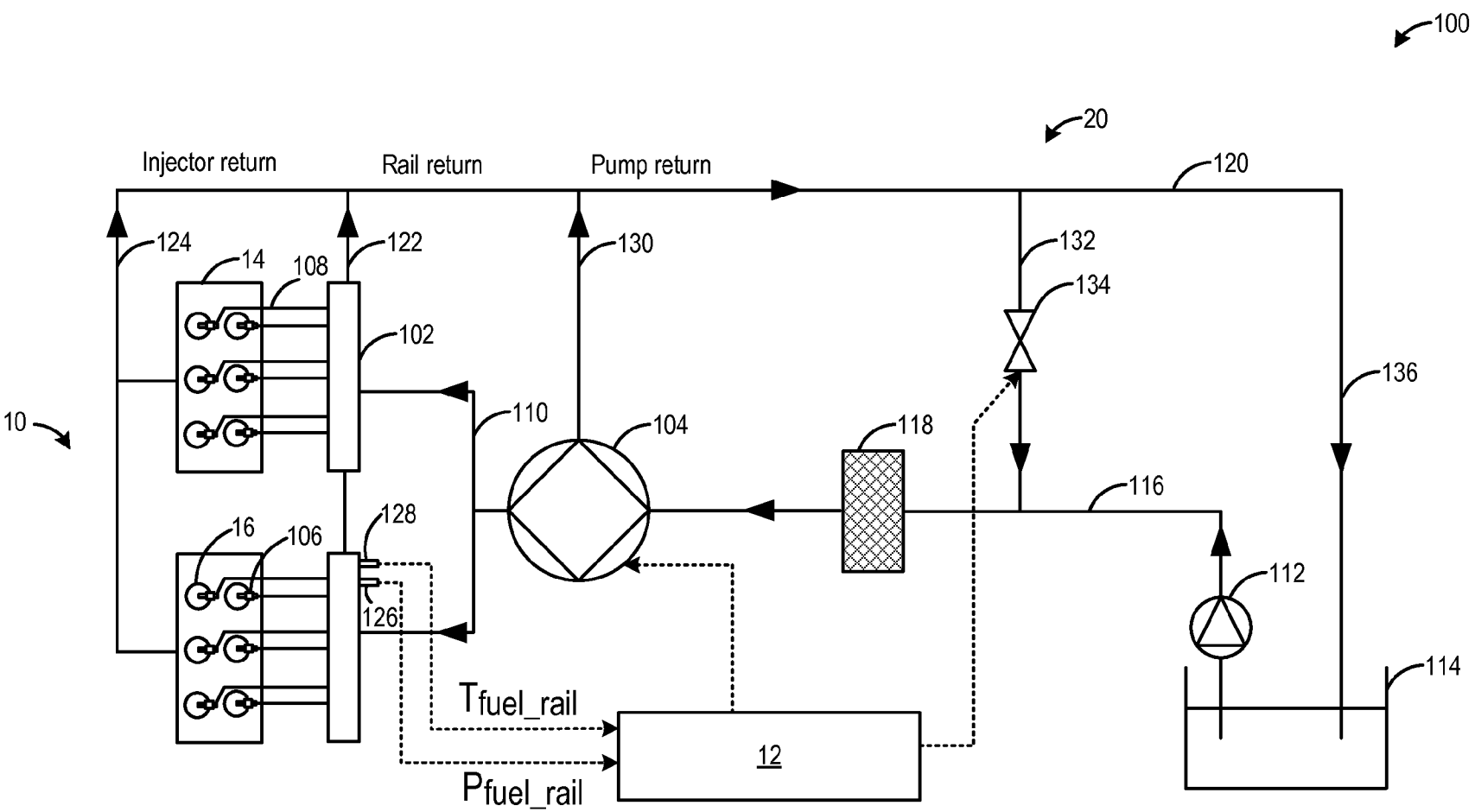
FIG. 1 shows an example vehicle system layout, including details of a fuel system.
Figure 2:
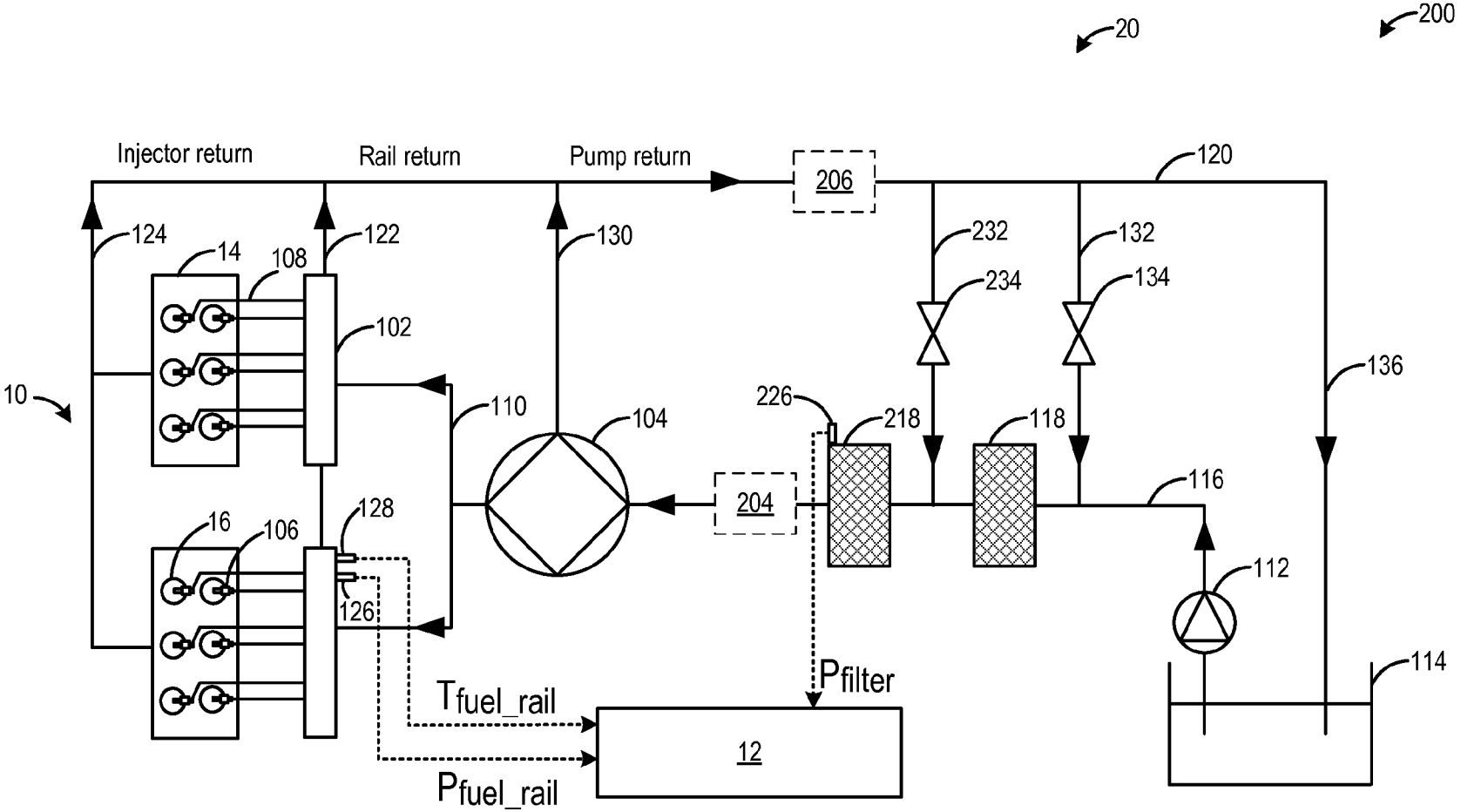
FIG. 2 shows a detailed example embodiment of the fuel system of FIG. 1.

The following description relates to systems and methods for operating a fuel system in a diesel-fuelled engine. As depicted in FIGS. 1-2, the fuel system may be configured with one or more recirculation valves for recirculating heated return fuel through one or more fuel filters. By recirculating diesel fuel that has been heated following pressurization and discharge from a supply fuel pump, wax removal may be expedited. An engine controller may be configured to adjust the operation of the supply pump at least between a more power-intensive pressure-controlled mode and a more energy-efficient volume-controlled mode responsive to both a fuel temperature and pressure, by performing a control routine, such as the routine depicted in FIG. 3, during engine cold-starts. The engine controller may further adjust fuel recirculation through the fuel filters responsive to the fuel temperature and/or pressure. By adjusting fuel pump operation responsive to a fuel temperature and pressure, wax precipitation from the diesel fuel may be reduced without prolonged high-power pump operation. The engine controller may further perform a diagnostics routine, such as the routine depicted in FIG. 4, to diagnose whether a fuel filter has clogging issues, and further to distinguish clogging due to wax build-up from plugging due to the build-up of contaminating matter such as dust. In this way, it may be determined whether the filter requires replacement or not. By reducing wax precipitation from the diesel fuel, the fluidity of the fuel may be increased and the performance of the fuel system may be improved. Additionally, by reducing the duration of operation of the fuel pump in the more power-intensive mode, fuel economy benefits may also be achieved.

FIG. 1 depicts an example vehicle system 100. In the depicted embodiment, vehicle system 100 is a diesel-fuelled vehicle system. The driving force of the vehicle system may be generated by engine 10. Engine 10 includes two banks 14, each bank including six cylinders 16. While engine 10 is shown as a 12-cylinder, V-shaped, four-stroke engine, it will be appreciated that the engine may have a different cylinder configuration (for e.g., in-line, or opposed) and/or a different number of cylinders (e.g., six, or eight).

Engine 10 of the vehicle system 100 includes a fuel system 20. Fuel system 20 includes fuel rails 102, supply pump 104, and fuel injectors 106. Fuel rails 102 may be interconnected and may each provide a chamber for holding fuel for subsequent injection into cylinders 16 through fuel injectors 106. In the depicted example, each fuel rail 102 may provide pressurized fuel to fuel injectors 106 on the corresponding bank 14 along high-pressure injector passage 108. Fuel rail 102 may include one or more fuel rail pressure sensors/switches 126 for sensing fuel rail pressures ($P_{fuel_rail}$) and one or more fuel rail temperature sensors 128 for sensing fuel rail temperatures ($T_{fuel_rail}$) and communicating the same with an engine controller 12. Only one fuel rail pressure sensor/switch 126 and one fuel rail temperature sensor 128 is shown for simplicity. Additional fuel rail pressure regulators may also be included. In the depicted example, fuel injectors 106 may be of the direct injection type, although it will be appreciated that they may alternately be of the port injection type. Further still, each cylinder may include more than one injector, some of the injectors being of the direct injection type while others are of the port injection type.

Fuel may be pressurized by supply pump 104 and transferred to fuel rails 102 along high-pressure rail passage 110. In one example, supply pump 104 may be driven by the rotation of engine 10, such as by an engine crankshaft and/or an engine camshaft. Alternatively, supply pump 104 may be driven by an optional electric motor.

Controller 12 may be configured to alternate operation of the supply pump at least between a pressure-controlled mode (herein also referred to as PCV mode) and a volume-controlled mode (herein also referred to as VCV mode) based on a temperature and pressure of the fuel. As such, when operating in the PCV mode, the pump may operate to provide the desired supply by running at wide open throttle. Thus, in the PCV mode, the pump may be operating at a high load and may consume more energy (for example, 5 kW more) as compared to the VCV mode. Furthermore, the pressurization of the fuel in the PCV mode may enable a more rapid fuel temperature increase. In contrast, when operating in the VCV mode, the supply pump may operate to provide a desired volume of fuel. As such, in the VCV mode, the pump may be operating at a lower load and may be more energy-efficient, and thus more fuel-efficient.

A low pressure feed pump 112 may be configured to draw low-pressure fuel from fuel tank 114 and feed in into supply pump 104 for subsequent pressurization and injection. In one example, fuel tank 114 may include a fuel type sensor (not shown) for determining a type of fuel in the tank. Low pressure fuel drawn by feed pump 112 may be transferred to supply pump 104 along low pressure passage 116 after passing through a first fuel filter 118. First fuel filter 118 may be configured to remove extraneous matter, such as dust and water, from the fuel to protect the rest of the fuel system of the vehicle.

Fuel rails 102 may also be configured to return fuel, and thereby reduce fuel pressure, into low pressure recirculation passage 120 via rail return flow passage 122. A pressure reducing valve at the rail outlet (not shown) may regulate the return flow of fuel from the fuel rail into recirculation passage 120. Similarly, fuel returned from injectors 106 may also be fed into recirculation passage 120 via injector return flow passage 124. Supply pump 104 may also be configured to return fuel, and thereby reduce fuel pressure; into recirculation passage 120 via pump return flow passage 130. A pressure reducing valve at the pump's outlet (not shown) may regulate the return flow of fuel from the supply pump into the recirculation passage. As such, the fuel returned from the supply pump, injectors, and/or rail may hereinafter also be referred to as the return fuel.

In diesel-fuelled engines, wax may precipitate out of the fuel at low temperature, such as experienced during an engine cold-start. In such a case, first fuel filter 118 may get clogged, thereby reducing fuel fluidity. In severe cases, supply pump damage and engine stalls may ensue. To address wax build-up and maintain fuel fluidity, return fuel (that is, fuel pressurized by supply pump and returned from the supply pump, injectors and/or fuel rail) may be re-circulated into the inlet of first fuel filter 118. As such, during pressurization, the fuel may also get rapidly heated. Thus, by recirculating heated return fuel through the fuel filter, wax removal at the filter may be expedited and potential issues related to wax build-up at the filter may be addressed.

Specifically during recirculation, the heated return fuel may be returned to recirculation passage 120, from where it may be re-circulated into the inlet of first fuel filter 118 through recirculation branch passage 132. A thermal recirculation valve 134 may regulate the return fuel flow entering first fuel filter 118. The remaining return fuel may be returned to fuel tank 114 along return conduit 136. In one example, the thermal recirculation valve may be fully opened at lower fuel temperatures and all the return fuel may be re-circulated, while at higher fuel temperatures, the thermal recirculation valve may be fully closed and all the return fuel may be returned to the fuel tank. In another example, the thermal recirculation valve may only be partially opened, such that at least some return fuel is recirculated. The engine controller may regulate flow through the recirculation valve by adjusting a degree of opening of the thermal recirculation valve and/or duration of opening of the thermal recirculation valve, responsive to the fuel temperature and/or pressure.

While the depicted example shows a single fuel filter, in alternate embodiments, as further elaborated with reference to FIG. 2, two or more filters may be included. Each filter may receive return fuel from respective recirculation branch passages. In one example, flow through each passage may be regulated by respective thermal recirculation valves. A pressure of fuel at the filter may be communicated to the engine controller by a filter pressure sensor/switch (not shown) positioned at the outlet of the filter. Additional sensors, such as a fuel temperature sensor may also be included.

As such, feed pump 112, low pressure passage 116, recirculation passage 120, recirculation branch passage 132, return flow passages 122, 124, 130, first fuel filter 118 and thermal recirculation valve 134 may constitute a low pressure section of the fuel system 20. Similarly, supply pump 104, supply passages 110, 108, fuel rails 102 and injectors 106 may constitute a supply section of the fuel system 20.

Engine controller 12 may be coupled to various sensors and may be configured to receive a variety of sensor signals from the various sensors. The sensors may include a vehicle speed sensor, a throttle opening-degree sensor, an engine rotational speed sensor, a battery state of charge sensor, an ignition switch sensor, a brake switch sensor, a gear sensor, a driver request sensor, various temperature sensors, including engine coolant temperature sensor, fuel rail temperature sensor 128, a fuel rail pressure regulator, intake temperature sensor, exhaust temperature sensor, and various pressure sensors/switches, including a fuel rail pressure sensor/switch 126 and a filter pressure sensor/switch. The engine controller 12 may also be coupled to various actuators of the vehicle system and may be further configured to control the operation of the various actuators, including the fuel injectors 106, supply pump 104, and thermal recirculation valve 134.

Figure 3:
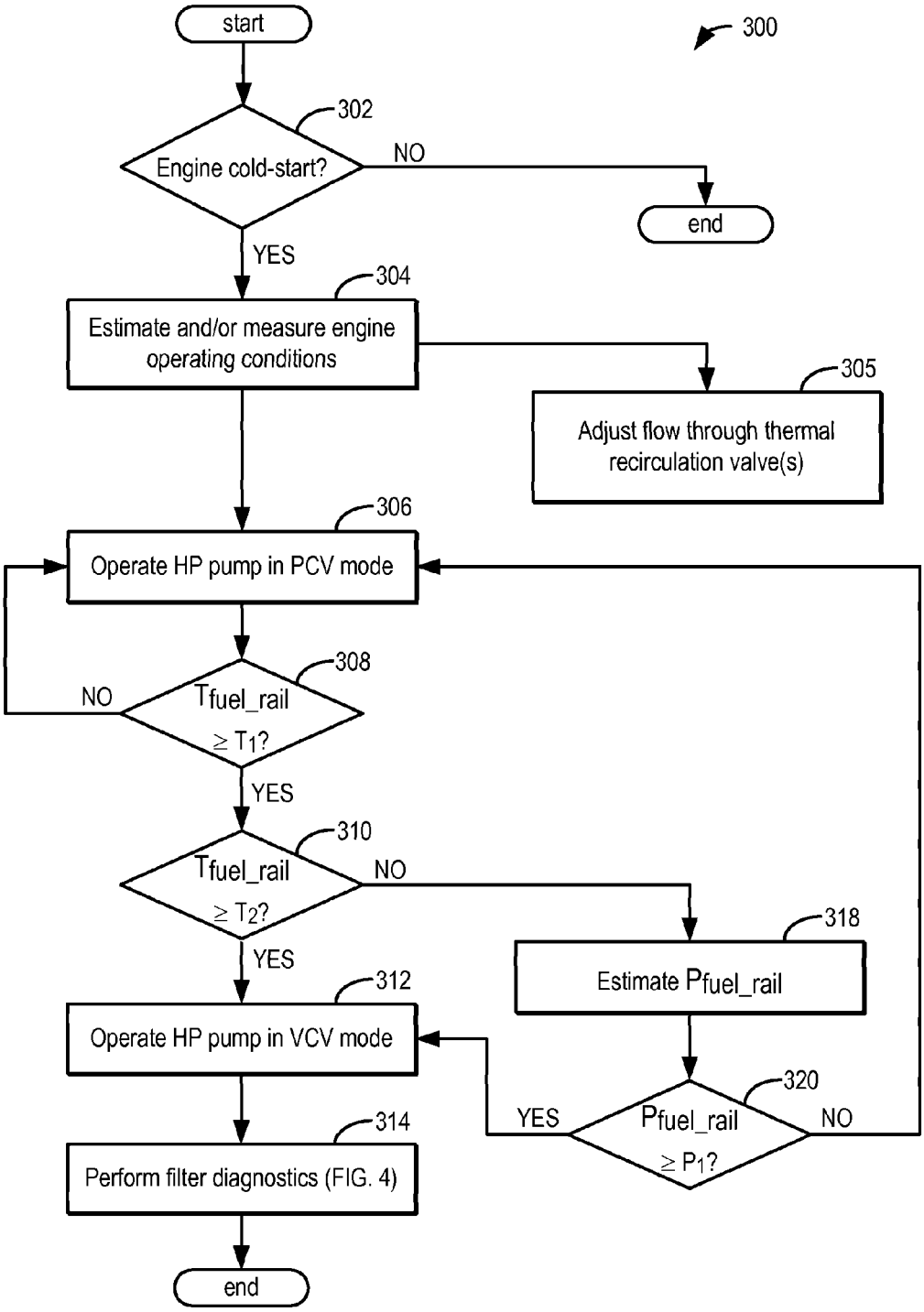
FIG. 3 shows a high level flow chart for operating the fuel system of FIG. 1 to reduced wax precipitation, according to the present disclosure.

As further elaborated with reference to FIG. 3, thermal recirculation valve 134 and supply pump 104 may be operated by controller 12 responsive to a fuel rail pressure. During an engine cold-start, the controller may be configured to operate supply pump 104 in the more power-intensive PCV mode only under conditions where the fuel temperature and pressure is below a predetermined threshold. The engine controller may be further configured to adjust the operation of the thermal recirculation valve 134 responsive to the fuel temperature and/or pressure, thereby adjusting the amount of heated return fuel that is recirculated. In this way, the supply pump may be operated in the PCV mode for enough time to increase an amount of hot return fuel that is recirculated through the fuel filters. By adjusting a flow of heated return fuel through the fuel filters, wax build-up may be reduced and fuel fluidity may be maintained. By maintaining fuel fluidity, the duration for which the supply pump may need to be operated in the more power-intensive mode may be reduced, thereby providing fuel economy benefits.

FIG. 2 depicts an alternate embodiment 200 of the fuel system 20 of FIG. 1. It will be appreciated that components previously introduced in FIG. 1 may be numbered similarly and may not be reintroduced for reasons of brevity.

As illustrated, feed pump 112 may be configured to draw fuel at low pressure from fuel tank 114 and feed it into supply pump 104 following passage through first fuel filter 118 and second fuel filter 218. As such, second fuel filter 218 may be positioned upstream of first fuel filter 118. In alternate embodiments, more or less filters may be used. Fuel filters 118 and 218 may have similar filtration properties. Alternatively, the different filters may have varying filtration characteristics. In one example, first fuel filter 118 may be configured to perform 10 μm filtration at 100% flow, while second fuel filter 218 may be configured to perform 4 μm filtration at 100% flow. In some embodiments, the first and/or second fuel filter may additionally be coupled to a low pressure pump, internal or external to the fuel tank, to pump fuel through the filter. The outlet of fuel filter 118 and/or 218 may further include a filter pressure sensor/switch 226 (herein depicted only on filter 218) for sensing fuel pressures at the inlet to the supply pump ($P_{filter}$). Similarly, a filter fuel temperature sensor may be included (not shown) for sensing fuel temperatures at the outlet of the filter in the fuel system ($T_{filter}$) and communicating the same with engine controller 12.

In some embodiments, supply pump 104 may include an auxiliary pump (not shown), such as an integrated gear pump or a low pressure electric pump, to enable higher fuel pressures to be achieved. A throttle (not shown) may regulate fuel flow from the auxiliary pump in to supply pump 104. An air removal module 204 may be optionally included to remove excess air drawn into the fuel system.

Return fuel from fuel rails 102, injectors 106, and supply pump 104 may be returned to fuel tank 114 along return conduit 136, or recirculated through fuel filters 118 and 218, through recirculation passage 120. In some embodiments, a return flow valve may be included at the outlet of the injectors to regulate the flow of injector return fuel into the recirculation passage. In alternate embodiments, a throttle may be used to regulate the flow of injector return fuel into the recirculation passage. A fuel cooler 206 may be optionally included in recirculation passage 120 for cooling the return fuel.

Under some conditions, such as during engine cold-starts, when fuel temperatures are low, at least some return fuel may be recirculated through fuel filters 118 and 218 instead of being returned to fuel tank 114. As such, the return fuel may be heated during passage and pressurization through supply pump 104. Specifically, the heated return fuel from recirculation passage 120 may be recirculated into the inlet of first fuel filter 118 through recirculation branch passage 132 and into the inlet of second fuel filter 218 through recirculation branch passage 232. A first thermal recirculation valve 134 may regulate the amount of return fuel flow entering first fuel filter 118 while a second thermal recirculation valve 234 may regulate the amount of return fuel flow entering second fuel filter 218. The remaining return fuel may be returned to fuel tank 114 along return conduit 136. While the depicted embodiment shows two fuel filters and two thermal recirculation valves, in alternate embodiments, the second thermal recirculation branch passage and second thermal recirculation valve may be omitted and an amount of return flow flowing through the two fuel filters may be regulated by adjusting flow through a single thermal recirculation valve, such as first thermal recirculation valve 134.

As further elaborated in FIG. 3, flow through the (first and second) thermal recirculation valves may be adjusted by controller 12 responsive to a fuel temperature and/or pressure. In one example, the engine controller may be configured to fully open and fully close the first and second thermal recirculation valves sequentially, the order of opening and closing based on the fuel temperature and/or pressure. In another example, the engine controller may be configured to keep the first and second recirculation valves partially fully open when the fuel temperature is below a threshold temperature. In this way, by using two or more recirculation passages for recirculating return fuel through the fuel filters, adequate heat may be provided to effectively remove wax from the filters.

While the depicted embodiment shows the injector return flow and rail return flow feeding into the low pressure recirculation passage 120 upstream of the thermal recirculation valves, it will be appreciated that in alternate embodiments, each of the injector return flow, rail return flow, and pump return flow may additionally, or optionally, be fed into low pressure passage 116. In one example, the return flow (from the injectors and/or the fuel rail) may be fed into low pressure passage 116 at a point downstream of the fuel filters. Alternatively, the return flow may be fed into low pressure passage at a point upstream of first fuel filter 118 and/or second fuel filter 118. Similarly, pump return flow may be optionally returned to low pressure passage 116 substantially downstream of the filters, at a point just upstream of the supply pump and any associated auxiliary pump.

Engine controller 12 may be configured to perform a control routine, as further elaborated in FIG. 3, to adjust the operating mode of the supply pump and further adjust flow through the recirculation valves during an engine cold-start. By recirculating heated return fuel through the fuel filters during an engine cold start, the amount of wax precipitated from the diesel fuel may be reduced, thereby reducing filter clogging. Further, the fluidity of the fuel may be improved. By adjusting the operating mode of the supply pump responsive to both a fuel temperature and pressure, substantial fuel economy benefits may be achieved.

Referring now to FIG. 3, routine 300 may include, at 302, confirming an engine cold start condition. In one example, confirming an engine cold start condition may include confirming that a catalyst temperature is below a threshold temperature (such as a light-off temperature). In another example, an engine cold start condition may include confirming that the vehicle has been in an engine-off condition for greater than a threshold time. In still another example, confirming an engine cold start condition may include confirming that, following a previous engine operation, the engine temperature has cooled to an ambient temperature. As such, based on the nature of the engine cold-start condition, the temperature at which the engine cold-start routine is initiated may vary. If an engine cold start condition is not present, the routine may end.

If an engine cold-start is confirmed, at 304, engine operating conditions may be estimated and/or measured. These may include, for example, estimating a temperature and pressure of fuel in the tank, and determining a type of fuel in the fuel tank (for example, mineral diesel or biodiesel, a percentage of biodiesel, etc.). Additionally, these may include estimating a temperature and pressure of fuel in the fuel rail, a temperature and pressure of fuel at the filters, etc.

At 305, based on the fuel temperature and/or pressure estimated at 304, flow through the thermal recirculation valve (s) may be adjusted. That is, an amount of return fuel that is recirculated is adjusted. In one example, the thermal recirculation valves may be opened and closed sequentially. For example, second fuel thermal recirculation valve 234 may be fully opened while first fuel thermal recirculation valve 134 is fully closed when the fuel temperature is lower than a first temperature (such as below 20° C.). Then, first thermal recirculation valve 134 may be fully opened when the fuel temperature is above the first temperature but lower than a second temperature (such as below 35° C.). Similarly, second thermal recirculation valve 234 may be fully closed once the fuel temperature has reached a third temperature (such as above 30° C.) while first thermal recirculation valve 134 remains fully open. Then, first thermal recirculation valve 134 may be fully closed once the fuel temperature has reached a fourth temperature (such as above 45° C.). In another example, both the first and second thermal recirculation valves may be partially opened, to enable partial flow through both the valves, when the fuel temperature is below a threshold.

In one example, adjusting the amount of return fuel that is recirculated through the recirculation valves may include decreasing the amount of return fuel that is recirculated through the fuel filter(s), and correspondingly increasing an amount of return fuel that is returned to the tank, as the fuel temperature increases. Herein, the amount of return fuel recirculated may be decreased by reducing the degree of opening of the thermal recirculation valves. Alternatively, or additionally, the amount of return fuel recirculated may be decreased by reducing the duration of opening of the thermal recirculation valve.

While the mentioned examples adjust the valve operation responsive to fuel temperature, in alternate examples the valve operation may be similarly adjusted responsive to fuel pressure and/or temperature. In this way, by using multiple thermal recirculation passages and thermal recirculation valves, the amount of hot return fuel passed through the fuel filters may be increased, thereby enabling faster removal of fuel wax during cold engine start conditions.

At 306, the supply pump may be operated in the PCV mode. As such, the PCV mode may represent a default operating mode of the supply pump during initial engine operation. In one example, the supply pump may be operated in the PCV mode for at least a predetermined duration, such as for 30 seconds. In one example, the duration may represent a minimum amount of time required to bring the diesel fuel up to a first (lower) temperature threshold. The temperature threshold may represent a temperature at which wax precipitation from the diesel fuel may be substantially reduced. In one example, the duration may be a predetermined fixed value. In another example, the duration may be recalibrated at each engine cold-start based on previous operation cycles, such as based on a previous indication of fuel filter clogging. For example, if a larger amount of wax was built-up in the previous cycle, the duration of PCV mode operation may be increased. In the PCV mode, the supply pump may be operating at wide open throttle and full power to enable a rapid pressurization of the fuel. As such, during the PCV mode, the engine controller may also be configured to learn the volume of fuel required to provide a desired pressure, for subsequent use in the VCV mode.

At 308, the temperature of fuel pressurized by the supply pump (for example, as represented by the fuel rail temperature $T_{fuel_rail}$) may be estimated and it may be determined whether $T_{fuel_rail}$ is greater than a first threshold temperature $T_1$ (for example, 20° C.). In one example, a fuel rail temperature sensor may be used to estimate the fuel temperature. The first threshold temperature may represent a minimum temperature enabling threshold fuel fluidity. Furthermore, the first threshold temperature may be adjusted on each cycle based on previous operation cycles. If the fuel temperature is below the first threshold temperature, the routine may return to 306 and continue operating the supply pump in the pressure-controlled (PCV) mode.

In contrast, when the fuel temperature is above the first threshold temperature, then at 310, it may be determined whether $T_{fuel_rail}$ has reached a second threshold temperature. In one example, the second threshold temperature may be adjusted based on the fuel type, as determined by the fuel type sensor. For example, a lower threshold may be assigned when the fuel type is biodiesel and a higher threshold may be assigned when the fuel type is mineral diesel. However, in other examples the fuel type may be unknown. However, by considering both fuel pressure and temperature in selecting the pump mode and in controlling fuel recirculation, it is possible to account for different fuel types in providing sufficient wax removal, while also reducing excess operation in a high workload of the pump.

During the condition where the fuel temperature is above the first and second threshold temperature, at 312, the controller may discontinue operation of the supply pump in the pressure-controlled mode and switch pump operation to the fuel-efficient volume-controlled (VCV) mode. As such, in the VCV mode, the supply pump may be operated at less than wide-open throttle and reduced load. Herein, the supply pump may be configured to adjust a volume of fuel flowing through the pump to provide the pressure. The controller may learn the flow volumes corresponding to the different pressures during previous cycles when operating in the PCV mode. Accordingly, the controller may update a map that may be stored in the controller's memory. The map may be used to determine the volume characteristics required during pump operation the VCV mode.

If at 310, the fuel temperature has not reached the second threshold temperature, that is, the fuel temperature is between the first and second threshold temperatures, at 318, a fuel pressure ($P_{fuel_rail}$) may be estimated. In one example, a fuel rail pressure sensor/switch may be used to estimate the fuel pressure. At 320, it may be determined whether $P_{fuel_rail}$ is greater than a first threshold pressure (for example, 4.5 kPa). The first threshold pressure may be adjusted based on engine operating conditions, such as, an engine speed, an engine load (or driver torque), an amount of fuel remaining in the tank (or rate of fuel consumption), etc. For example, the pressure may be adjusted responsive to fuel tank levels by a simple transfer function based on the fuel tank level. As such, the first pressure threshold may represent a pressure above which wax precipitation may be substantially reduced, when also operating above the first threshold temperature.

During the condition where the fuel temperature is above the first threshold but below the second threshold, and further the fuel pressure is above the first threshold pressure, the routine may return to 312 and operate the supply pump in the VCV mode. That is, when the fuel temperature is above the first threshold temperature and the fuel pressure is above the first threshold pressure, the supply pump is forced into a VCV mode to enable improved fuel economy. Under these conditions, substantially lower wax precipitation may be anticipated. Thus, under these conditions, the fluidity of the fuel may be better and an unnecessarily prolonged operation of the pump in the pressure-controlled mode may be discontinued, thereby reducing power consumption. In contrast, during the condition where the fuel temperature is above the first threshold but below the second threshold, and further the fuel pressure is below the first threshold pressure, the routine may return to 306 and operate the supply pump in the PCV mode. That is, if the fuel pressure is below the first threshold pressure, the supply pump may remain in the power-intensive PCV mode even when the fuel temperature is above the first threshold temperature.

Figure 4:
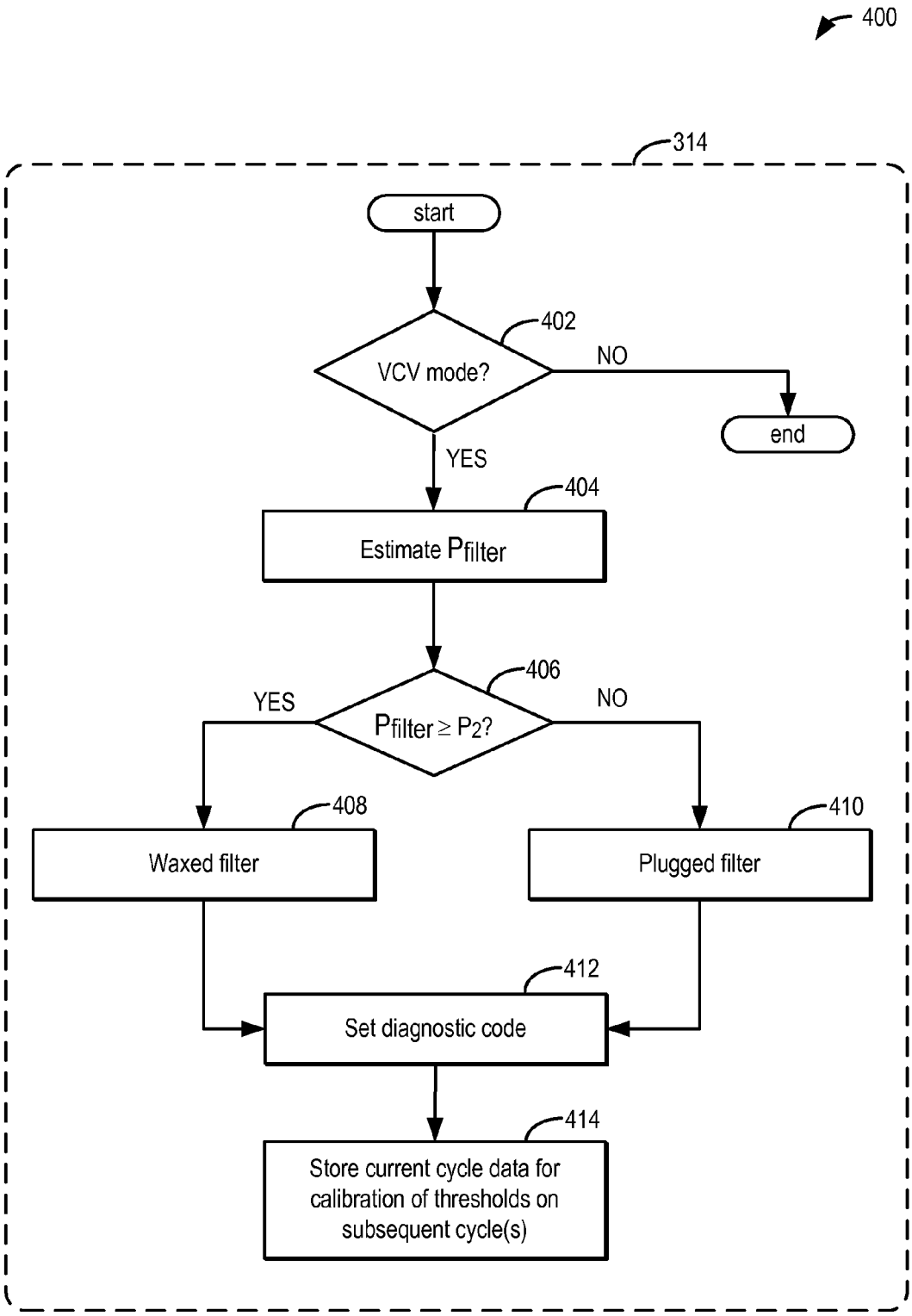
FIG. 4 shows a high level flow chart for diagnosing filter clogging due to wax build-up in the fuel system of FIG. 1, according to the present disclosure.

At 314, while operating the pump in the VCV mode, the controller may further perform a diagnostics routine, as further elaborated in FIG. 4, to identify fuel filter clogging based on a fuel filter pressure. Specifically, the controller may indicate fuel filter clogging and differentiate between filter clogging due to wax build-up and clogging due to deposition of extraneous matter (such as dust and water).

As such, the amount of wax precipitating from diesel fuel is dependent on both the temperature and pressure properties of the fuel system. The temperature and pressure characteristics of wax precipitation in the filter may additionally depend on the type of diesel fuel used (for example, based on whether the fuel is bio-diesel or mineral diesel and the cold properties of the fuel). Thus, by adjusting a pump operating mode based on fuel temperature and pressure, wax removal at the filter may be improved. As such, the combination of a temperature and pressure threshold may enable substantially lower temperature thresholds to be used. Thus, for example when operating with bio-diesel fuels, wherein the combination of a lower fuel temperature and a higher fuel pressure may enable substantial fuel fluidity and wax removal, the use of a lower temperature threshold and a higher pressure threshold may enable the pump to be operated for a shorter time in the PCV mode. In contrast, the use of a routine responsive only to fuel temperatures may entail substantially higher temperature thresholds, thereby prolonging the duration of the pump in the PCV mode. In this way, by adjusting a pump operating mode based on fuel temperature and pressure the supply pump may be operated in the PCV mode until both the fuel temperature and pressure have attained threshold values. By shifting operation of the supply pump to the VCV mode once the fuel temperature and pressure have attained the threshold value, wax precipitation and fuel filter clogging issues may be reduced without adversely affecting the vehicle's fuel economy.

Referring now to FIG. 4, a diagnostics routine 400 is illustrated. The diagnostics routine may be performed during a cold-start operation, specifically when the supply pump is in the VCV mode. In one example, as illustrated, diagnostic routine 400 may be performed as part of an engine cold-start routine 300 at step 314.

Routine 400 may include, at 402, confirming that the supply pump is operating in the VCV mode. As such, this may include confirming that the fuel temperature ($T_{fuel_rail}$) is above the second temperature threshold. If the supply pump is not in the VCV mode, for example, the supply pump is in the PCV mode, and then the routine may end. If a VCV mode is confirmed, then at 404, the filter fuel pressure ($P_{filter}$) may be estimated. In one example, a pressure sensor/switch at the outlet of the first fuel filter may be used to estimate the fuel pressure. In another example, when the fuel system includes more than one fuel filters, such as the embodiment of FIG. 2, a pressure sensor/switch 226 positioned at the outlet of the second fuel filter or inlet to the supply pump may be used to estimate fuel pressure. In alternate embodiments, each fuel filter may include a pressure sensor/switch at the outlet and the pressure data from both filters may be used to estimate an average filter fuel pressure.

At 406, it may be determined whether $P_{filter}$ is above a second threshold pressure. In one example, the pressure data may be monitored for a predetermined duration while the supply pump operates in the VCV mode. If the filter pressure is above the second pressure threshold, then at 408, the controller may indicate fuel filter clogging due to wax build-up. In contrast, if the filter pressure is below the second pressure threshold, then at 410, the controller may indicate fuel filter clogging due to build-up of extraneous materials, such as dust. At 412, the controller may indicate filter clogging, and the nature of the clogging, by setting a diagnostics code.

As one example, at the onset of an engine cold start, when the fuel temperature is low, the fuel filter pressure may be estimated. As such, during the engine cold start, at least a part of the pressure across the fuel filter may be indicative of wax that has precipitated from the diesel fuel and has been trapped at the filter. The pressure downstream of the filter (and upstream of the supply pump) may be a low pressure and may necessitate substantial work by the supply pump for circulation through the fuel system. Then, while and/or after heated return fuel is recirculated through the fuel filter, the pressure may be monitored. In one example, as heated return fuel is passed through the filter, the pressure downstream of the filter may increase (for example, increase slightly to reach the second threshold pressure) due to a rapid meltdown of the wax and an increase in the fluidity of the fuel. In another example, the fuel filter may be plugged by dust and other particulate matter. In this case, the passage of heated return fuel may not substantially affect the filter pressure. Thus, based on the change in the filter pressure, the engine controller may diagnose whether wax build-up had occurred at the filter and if it was properly addressed by the recirculation of the heated return fuel. Then, based on the nature of the clogging, a diagnostics code may be set. As such, the filter may require more frequent replacement when the clogging issue is due to dust and related materials. In contrast, when the clogging issue is due to wax build-up, the filter may not require replacement. Thus, when the filter is clogged due to dust related issues, a diagnostics code suggesting eventual filter replacement may be set. Additionally, use of a better quality fuel may be suggested to the driver.

At 414, the details of the current operation cycle may be stored in the controller for calibration of pressure and temperature thresholds for switching pump operation between PCV and VCV modes, and pump operation durations, in subsequent cycles. Specifically, the controller may adjust the first threshold temperature, the first threshold pressure, and the second threshold pressure for subsequent cycles based on a previous indication of fuel filter clogging. That is, based on the results of the diagnostic routine; it may be determined whether the passage of heated return fuel through the fuel filter appropriately addressed the wax build-up issues, during the current cycle. As one example, if it is diagnosed that a larger amount of wax build-up occurred on a previous cycle, or that the wax build-up was not effectively treated with the initial run of the pump in the PCV mode, the duration of initial operation of the supply pump in the PCV mode may be increased (for example, more than 30 seconds) in subsequent cycle(s). As another example, if it is diagnosed that the wax build-up was appropriately addressed, the duration of initial operation of the supply pump in the PCV mode may be decreased or maintained (for example at 30 seconds) in the subsequent cycle(s). Similarly, if a larger amount of wax build-up is diagnosed, the first threshold temperature and/or first threshold pressure may be raised in anticipation of more wax build-up in future cycles. Additionally, the amount of heated return fuel recirculated through the filters may be increased. In this way, potential wax build-up related issues may be anticipated and operation of the fuel system may be accordingly adjusted.

In this way, by adjusting the operation of a fuel supply pump responsive to fuel temperature and pressure, wax build-up may be addressed in an energy-efficient manner for a variety of fuel types and operating conditions. By further adjusting the recirculation of heated fuel through fuel filters responsive to fuel temperature and/or pressure, wax removal at the fuel filters may be expedited. Additionally, by updating pump and recirculation valve operating characteristics based on previous diagnoses of filter clogging, wax related issues may be addressed more efficiently and effectively.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A method of operating a fuel system in an engine, the fuel system including a supply pump for pressurizing fuel received from a fuel tank, a fuel filter for filtering fuel supplied to the supply pump, a fuel rail, and a fuel injector, the method comprising, during an engine cold-start, operating the supply pump in a pressure-controlled mode during initial engine operation;

switching pump operation to a volume-controlled mode in response to a fuel temperature and pressure; and recirculating at least some return fuel from the fuel rail, injector, and/or pump through the fuel filter, via a thermal recirculation valve, based on the fuel temperature and/or pressure.

2. The method of claim 1, wherein switching pump operation in response to a fuel temperature and pressure includes, during a first condition, where the fuel temperature is below a first threshold temperature, operating the pump in the pressure-controlled mode;

during a second condition, where the fuel temperature is above a second threshold temperature, operating the pump in the volume-controlled mode;

during a third condition, where the fuel temperature is above the first threshold temperature but below the second threshold temperature, and further where the fuel pressure is below a first threshold pressure, operating the pump in the pressure-controlled mode; and during a fourth condition, where the fuel temperature is above the first threshold temperature but below the second threshold temperature, and further where the fuel pressure is above the first threshold pressure, operating the pump in the volume-controlled mode.

3. The method of claim 2, wherein recirculating return fuel based on the fuel temperature and/or pressure includes, as the fuel temperature increases, decreasing an amount of return fuel that is recirculated through the fuel filter while increasing an amount of return fuel that is returned to the fuel tank, the decreasing an amount of return fuel that is recirculated including at least one of reducing a degree of opening of the thermal recirculation valve and reducing a duration of opening of the thermal recirculation valve.

4. The method of claim further comprising, during the second condition, identifying fuel filter clogging and differentiating between filter clogging due to wax and fuel filter clogging due to particulate matter based on a fuel filter pressure, and further indicating fuel filter clogging by setting a diagnostic code.

5. The method of claim 4 wherein identifying and differentiating fuel filter clogging based on the fuel filter pressure includes, indicating fuel filter clogging due to wax when the fuel filter pressure is above a second threshold pressure during the second condition, and indicating fuel filter clogging due to extraneous matter when the fuel filter pressure is below the second threshold pressure during the second condition.

6. The method of claim 5 further comprising, adjusting the second threshold temperature based on the fuel type, and adjusting the first threshold temperature and/or the second threshold pressure based on a previous indication of fuel filter clogging, the adjustments including increasing the first threshold temperature based on a previous indication of fuel filter clogging due to wax.

7. A vehicle system, comprising, an engine;

a fuel system including, a supply pump for pressurizing fuel received from fuel tank;

a fuel rail for delivering pressurized fuel to a fuel injector;

a first fuel filter for filtering fuel supplied to the supply pump from the fuel tank;

a second fuel filter for filtering fuel supplied to the supply pump from the fuel tank, the second fuel filter positioned downstream of the first filter;

a first recirculation passage for recirculating return fuel returned from the fuel rail, fuel injector and/or supply pump to an inlet of the first fuel filter;

a second recirculation passage for recirculating return fuel returned from the fuel rail, fuel injector and/or supply pump to an inlet of the first fuel filter;

a first thermal recirculation valve, located in the first recirculation passage, for adjusting an amount of return fuel recirculated through the first fuel filter;

a second thermal recirculation valve, located in the second recirculation passage, for adjusting an amount of return fuel recirculated through the second fuel filter; and a control system configured to:

during an engine cold-start, operate the supply pump based on a fuel temperature and pressure; and recirculate at least some return fuel through the first and/or second fuel filter based on the fuel temperature and/or pressure.

8. The system of claim 7, wherein operating the supply pump based on a fuel temperature and pressure includes, during a first condition, where the fuel temperature is below a first threshold temperature, operating the pump in a pressure-controlled mode;

during a second condition, where the fuel temperature is above a second threshold temperature, operating the pump in a volume-controlled mode;

during a third condition, where the fuel temperature is above the first threshold temperature but below the second threshold temperature, and further where the fuel pressure is below a first threshold pressure, operating the pump in the pressure-controlled mode; and during a fourth condition, where the fuel temperature is above the first threshold temperature but below the second threshold temperature, and further where the fuel pressure is above the first threshold pressure, operating the pump in the volume-controlled mode.

9. The system of claim 8, wherein recirculating return fuel based on the fuel temperature and/or pressure includes, as the fuel temperature increases, decreasing an amount of return fuel that is recirculated through the first and/or second fuel filter while increasing an amount of return fuel that is returned to the fuel tank, the amount of recirculated return fuel decreased by at least one of reducing a degree of opening of the first and/or second thermal recirculation valve or reducing a duration of opening of the first and/or second thermal recirculation valve.

10. The system of claim 9 wherein the control system is further configured to, during the second condition, indicate fuel filter clogging due to wax when fuel filter pressure is above a second threshold pressure;

indicate fuel filter clogging due to particulate matter when the fuel filter pressure is below the second threshold pressure; and indicate fuel filter clogging by setting a diagnostic code.

11. The system of claim 8, wherein recirculating return fuel based on the fuel temperature and/or pressure includes, fully opening and fully closing the first and second thermal recirculation valves sequentially, the order of opening and closing based on the fuel temperature and/or pressure.

12. The system of claim 8, wherein recirculating return fuel based on the fuel temperature and/or pressure includes at least partially opening the first and second thermal recirculation valves when the fuel temperature is below a first temperature.

13. A method of operating a fuel system in an engine, the fuel system including a supply pump for pressurizing fuel received from a fuel tank, a fuel filter for filtering fuel, a fuel rail, and a fuel injector, the method comprising, during an engine cold-start, operating the supply pump; and adjusting a supply pump operation mode between at least a pressure-controlled mode and a volume-controlled mode based on a fuel temperature and pressure, wherein adjusting the supply pump based on fuel temperature and pressure includes, during a first condition, where the fuel temperature is below a first threshold temperature, operating the pump in the pressure-controlled mode;

during a second condition, where the fuel temperature is above a second threshold temperature, operating the pump in the volume-controlled mode;

during a third condition, where the fuel temperature is above the first threshold temperature but below the second threshold temperature, and further where the fuel pressure is below a first threshold pressure, operating the pump in the pressure-controlled mode; and during a fourth condition, where the fuel temperature is above the first threshold temperature but below the second threshold temperature, and further where the fuel pressure is above the first threshold pressure, operating the pump in the volume-controlled mode.

14. The method of claim 13, further comprising, during any of the first, second, third, or fourth conditions, adjusting an amount of return fuel that is recirculated through the fuel filter, via a thermal recirculation valve, based on the fuel temperature and/or pressure.

15. The method of claim 14, wherein the return fuel includes fuel returned from at least one of the fuel rail, the supply pump, and the fuel injector, and further wherein adjusting an amount of return fuel that is recirculated based on the fuel temperature and/or pressure includes decreasing the amount of return fuel that is recirculated through the fuel filter, and increasing an amount of return fuel that is returned to the fuel tank, as the fuel temperature increases.

16. The method of claim 15, wherein decreasing an amount of return fuel that is recirculated includes at least one of reducing a degree of opening of the thermal recirculation valve or reducing a duration of opening of the thermal recirculation valve.

17. The method of claim 13 further comprising, during the second condition, identifying fuel filter clogging and differentiating between filter clogging due to wax and fuel filter clogging due to extraneous matter based on a fuel filter pressure, and further indicating fuel filter clogging by setting a diagnostic code.

18. The method of claim 17 wherein identifying and differentiating fuel filter clogging based on the fuel filter pressure includes, indicating fuel filter clogging due to wax when the fuel filter pressure is above a second threshold pressure during the second condition, and indicating fuel filter clogging due to particulate matter when the fuel filter pressure is below the second threshold pressure, during the second condition.

19. The method of claim 18 further comprising, adjusting the second threshold temperature based on the fuel type, and adjusting the first threshold temperature, the first threshold pressure, and/or the second threshold pressure based on a previous indication of fuel filter clogging.

* * * * *